US007497751B1

(12) United States Patent
White

(10) Patent No.: US 7,497,751 B1
(45) Date of Patent: Mar. 3, 2009

(54) ALTERNATIVE COOLING PATH SYSTEM FOR A MARINE PROPULSION DEVICE

(75) Inventor: Brian R. White, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 56 days.

(21) Appl. No.: 11/740,997

(22) Filed: Apr. 27, 2007

(51) Int. Cl.

| | |
|---|---|
| ***F02N 1/00*** | (2006.01) |
| *B63H 21/14* | (2006.01) |
| *B63H 21/10* | (2006.01) |
| *B63H 21/38* | (2006.01) |
| *F01P 3/20* | (2006.01) |
| *F02B 61/04* | (2006.01) |

(52) U.S. Cl. ..... 440/88 P; 440/88 R; 440/88 C

(58) Field of Classification Search ..... 440/88 R, 440/88 C, 88 P; 123/41.08; 251/12; 137/505
See application file for complete search history.

(56) References Cited

U.S. PATENT DOCUMENTS

| | | | | |
|---|---|---|---|---|
| 2,876,789 | A * | 3/1959 | Borden et al. | 137/217 |
| 4,801,283 | A * | 1/1989 | Ruhnke | 440/88 R |
| 4,991,546 | A * | 2/1991 | Yoshimura | 123/41.31 |
| 5,330,376 | A * | 7/1994 | Okumura | 440/88 R |
| 6,109,218 | A * | 8/2000 | Bachschmid et al. | 123/41.09 |
| 6,368,169 | B1 | 4/2002 | Jaeger | 440/88 |
| 6,379,201 | B1 | 4/2002 | Biggs et al. | 440/88 |
| 6,439,939 | B1 | 8/2002 | Jaeger | 440/88 |
| 6,652,337 | B1 | 11/2003 | Logan et al. | 440/88 J |
| 7,114,469 | B1 * | 10/2006 | Taylor | 123/41.08 |

* cited by examiner

*Primary Examiner*—Lars A Olson
*Assistant Examiner*—Daniel V Venne
(74) *Attorney, Agent, or Firm*—William D. Lanyi

(57) ABSTRACT

A cooling system of a marine propulsion device is provided with a valve that directs alternative flows of cooling water to portions of the marine propulsion system and apportions the cooling water flows in response to the speed of the water pump used to draw water from a body of water. Increasing pressures within the structure of the valve body change the proportion of water flowing through first and second coolant paths as engine speed increases.

17 Claims, 5 Drawing Sheets

ALTERNATIVE COOLING PATH SYSTEM FOR A MARINE PROPULSION DEVICE

BACKGROUND OF THE INVENTION

1. Field of the Invention

The present invention is generally related to a cooling system for a marine propulsion device and, more particularly, to a cooling system valve that selectively routes cooling water to portions of the marine propulsion system based on the magnitude of incoming water pressure from a water pump.

2. Description of the Related Art

Those skilled in the art of marine propulsion systems are familiar with many systems and devices that are utilized to appropriately direct and/or restrict the flow of cooling fluid through conduits of the marine propulsion device. Some devices are provided to inhibit disadvantageous flow while others are used to encourage advantageous flow.

U.S. Pat. No. 6,368,169, which issued to Jaeger on Apr. 9, 2002, discloses a marine engine cooling system with a siphon inhibiting device. A valve is provided for a marine engine cooling system and the purpose of the valve is to prevent the draining of the pump and outboard drive unit from creating a siphon effect that draws water from portions of the cooling system where heat producing components exist. The valve also allows intentional draining of the system when the vessel operator desires to accomplish this function. The valve incorporates a ball that is captivated within a cavity. If the ball is lighter than water, its buoyancy assists in the operation of the valve.

U.S. Pat. No. 6,439,939, which issued to Jaeger on Aug. 27, 2002, discloses a siphon inhibiting device for a marine cooling system. The siphon inhibiting valve comprises first and second portions of a housing structure and a buoyant member disposed within the housing structure for movement along a first axis between an inlet port and an outlet port. The buoyant member is shaped to have a cylindrical portion and another portion which is shaped in the form of a frustum of a cone. Upward movement of the buoyant member causes an elastomeric seal on the buoyant member to come into contact with an internal lip formed in the housing structure, thereby creating a seal that prevents an upward flow of water in a direction from the outlet port to the inlet port.

U.S. Pat. No. 6,379,201, which issued to Biggs et al. on Apr. 30, 2002, discloses a marine engine cooling system with a check valve to facilitate draining. The cooling system is provided with a valve in which a ball moves freely within a cavity formed within the valve. Pressurized water, from a sea pump, causes the ball to block fluid flow through the cavity and forces pumped water to flow through a preferred conduit which may include a heat exchanger. When the sea pump is inoperative, the ball moves downward within the cavity to unblock a drain passage and allow water to drain from the heat generating components of the marine engine.

U.S. Pat. No. 6,652,337, which issued to Logan et al. on Nov. 25, 2003, discloses an exhaust system for a marine propulsion engine. By providing a space between surfaces of a raised exhaust portion of the components and surfaces of the raised coolant portions of the exhaust system, leakage from the coolant conduits to the exhaust cavities is avoided. The space provided between exhaust portions of the manifold and elbow and coolant portions of the manifold and elbow, near the joint between these components, provides the two advantages of maintaining a higher exhaust connection between the manifold and the elbow and also preventing coolant leakage from flowing from the coolant passages to the exhaust passages of the exhaust system.

The patents described above are hereby expressly incorporated by reference in the description of the present invention.

In marine propulsion systems, it is important that cooling water be provided to remove heat from heat emitting portions of the system. However, the provision of cooling water must be provided in such a manner that certain components are not cooled to temperatures lower than desirable thresholds while other components are not deprived of sufficient cooling water flow to maintain their temperatures below upper thresholds. If cooling water, typically from a lake or body of water in which a marine vessel is operated, is provided at a rate higher than desired, certain components can be cooled below advantageous temperatures and this overcooling can result in condensation of moisture within those components. Therefore, it is desirable to limit the flow of cooling water to those components when the engine is not operating at sufficient speeds to generate heat commensurate with the cooling water flow. Alternatively, when an engine is operating at higher speeds, it is necessary to provide cooling water at a sufficiently high flow rate to prevent overheating those components. It would therefore be beneficial if a cooling system could be provided that simply and efficiently controls the flow of water between alternative paths in order to avoid the overcooling of certain components and the overheating of other components. It would be further beneficial if such a system could vary the direction of cooling water flow as a function of the rate of flow of the cooling water provided by a pump that draws the water from a body of water.

SUMMARY OF THE INVENTION

A cooling system for a marine propulsion system, made in accordance with a preferred embodiment of the present invention, comprises a water pump, first and second cooling paths, and a valve having an inlet connected in fluid communication with the water pump, a first outlet connected in fluid communication with the first coolant path, and a second outlet connected in fluid communication with the second coolant path. The valve is configured to increase coolant flow through the second outlet and decrease coolant flow through the first outlet in response to an increase in water pressure within the inlet from a first magnitude to a second magnitude.

In a particularly preferred embodiment of the present invention, the valve comprises a guide member and a movable member slidably supported on the guide member. The guide member is stationary relative to the first and second outlets and the movable member is movable toward the second outlet solely in response to the weight of the movable member. The movable member is also movable toward the first outlet in response to the increase in water pressure within the inlet above a threshold magnitude. The first coolant path can be disposed in fluid communication with a non-metallic component, such as an elastomeric connector, of an exhaust system of the marine propulsion system. The second coolant path can be disposed in fluid communication with an exhaust manifold of the marine propulsion system.

In a preferred embodiment of the present invention, the movable member comprises a first pressure responsive surface and a second pressure responsive surface. The first pressure responsive surface has a greater area than the second pressure responsive surface. The guide member comprises a rod, in a preferred embodiment of the present invention, and the movable member is slidably supported on the rod for reciprocal movement between the first and second outlets.

The rod is rigidly attached to a housing of the valve and is stationary relative to the first and second outlets.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
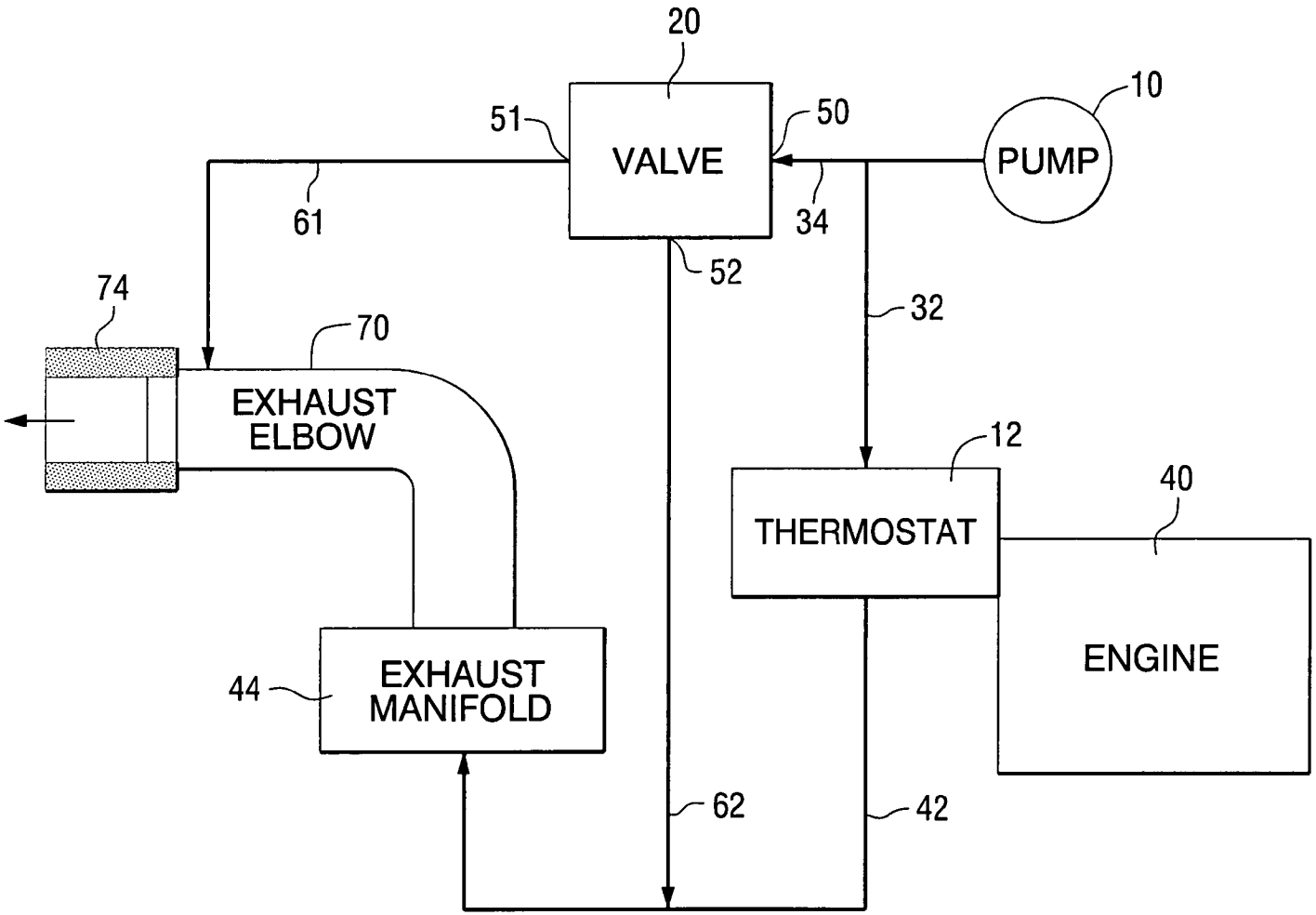
FIG. 1 is a simplified block diagram of a marine propulsion system.

Throughout the description of the preferred embodiment of the present invention, like components will be identified by like reference numerals.

FIG. 1 is a simplified functional block diagram of a cooling system for a marine propulsion device. A pump 10, sometimes referred to as a sea pump, draws water from a body of water and provides that water to a thermostat 12 and a valve 20, through conduits 32 and 34, respectively. The thermostat 12 controls the flow of cooling water into the cooling jacket of an engine 40 in a manner that is generally well known to those skilled in the art. Some water is directed by the thermostat 12 to flow through conduit 42 toward an exhaust manifold 44 of the marine propulsion system.

With continued reference to FIG. 1, some of the water flowing from the pump 10 flows to the valve 20. The operation of the valve 20 will be described in greater detail below. After the water flows into the inlet 50 of the valve, it is directed by the inner configuration of the valve 20 to a first outlet 51 or a second outlet 52. As will be described in greater detail below, the valve 20 selectively directs the flow of water to the first or second outlets, 51 or 52, as a function of the operating speed of the pump 10 and, as a result, the rate of water flow through conduit 34 to the inlet 50 of the valve 20. Water flowing through the first outlet 51 is conducted through a first cooling path 61. This water flows to the exhaust elbow 70 and maintains the temperature of an elastomeric connector 74 below an upper temperature threshold magnitude. This protects the elastomeric connector 74. Water flowing through the second outlet 52 flows along a second coolant path 62. This water flows to the exhaust manifold 44.

Throughout the description of the preferred embodiment of the present invention, the first and second coolant paths, 61 and 62, will be identified the same as the conduits through which they flow. In addition, the incoming flow of water into the inlet 50 will be identified by reference numeral 34 which also identifies the conduit through which it flows from the pump 10.

Figure 2:
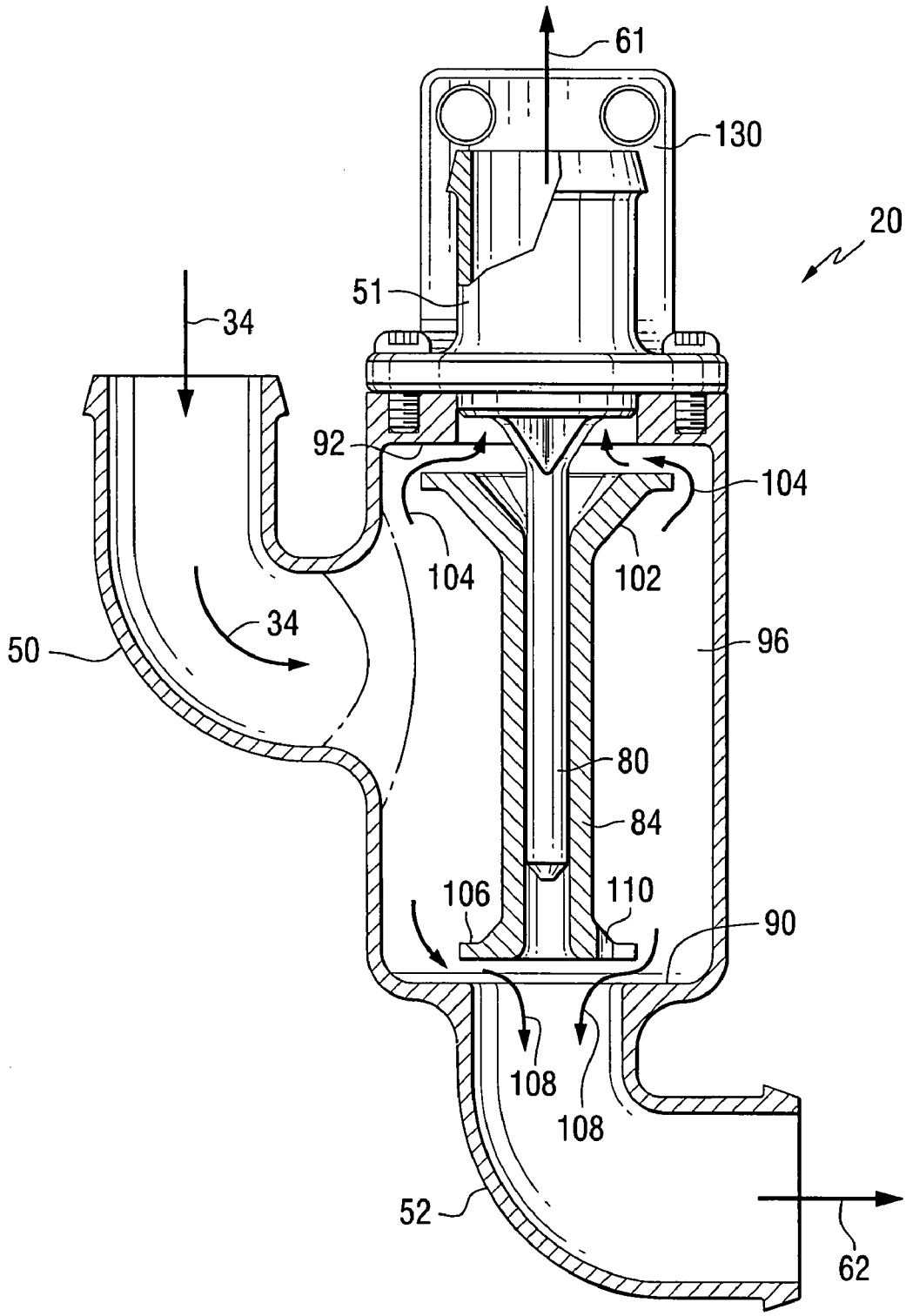
FIG. 2 is a section view of a valve which is suitable for use in certain embodiments of the present invention.

FIG. 2 is a partially sectioned view of a valve 20 that can be used to perform the function of the valve described above in conjunction with FIG. 1. Within the structure of the valve 20 shown in FIG. 2, a guide member 80 and a movable member 84 are shown. The movable member 84 is illustrated in a central position where its lower portion is not in contact with a lower surface 90 and its upper portion is not in contact with an upper surface 92. Instead, the movable member 84 is shown suspended midway between these two positions in order to facilitate the description of its operation. Incoming flow 34 passing through the inlet 50 flows into a central chamber 96. Depending on the position of the movable member 84, this incoming flow can pass in a generally upward direction around the upper portion 102 of the movable member 84. This flow is identified by arrows 104. It continues upwardly and forms the flow along the first coolant path 61 from the first outlet 51. Alternatively, when the lower portion 106 of the movable member 84 is raised above the lower surface 90, water can flow from the chamber 96 into the second outlet 52 as represented by arrows 108. Therefore, depending on the physical position of the movable member 84 relative to the lower 90 and upper 92 surfaces, flow can be encouraged or inhibited through the first and second outlets.

In a preferred embodiment of the present invention, the guide member 80 comprises a rod, as illustrated in FIG. 2, and the movable member 84 is slidably supported on the rod for reciprocal movement between the first and second outlets, 51 and 52. In the embodiment of the present invention shown in FIG. 2, an increased flow of water into the inlet 50 will raise the pressure within chamber 96 relative to both the first and second outlets, 51 and 52. Because of the relative effective areas of the upper portion 102 and lower portion 106 of the movable member 84, the pressure differentials between the water and the chamber 96 and the fluids in the first and second outlets will cause the movable member 84 to rise and move into contact with the upper surface 92, blocking the first outlet 51. Conversely, when the pressure within the chamber 96 is lowered because of decreased pump speed, the weight of the movable member 84 will cause it to move downwardly relative to the rod 80 and the lower portion 106 of the movable member 84 will move into contact with the lower surface 90, decreasing the amount of water flow through the second outlet 52. As illustrated in FIG. 2, a small opening 110 is formed in the lower portion 106 in order to provide a continuous flow of water through the second outlet even when the lower portion 106 of the movable member 84 is in contact with the lower surface 90. This facilitates draining of the system when the engine is turned off and the pump is inactive and also assures a continuous flow of water through the second outlet 52 at all times. These advantages will be described further below.

Figure 4:
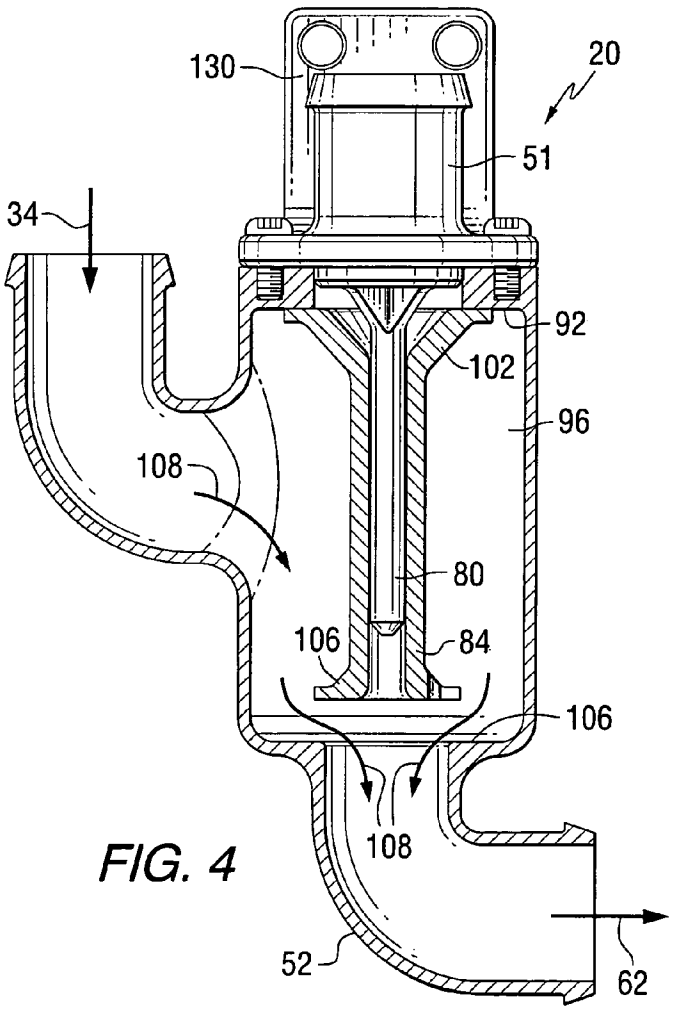
FIGS. 3 and 4 show the valve in two alternative conditions of operation.
Figure 3:
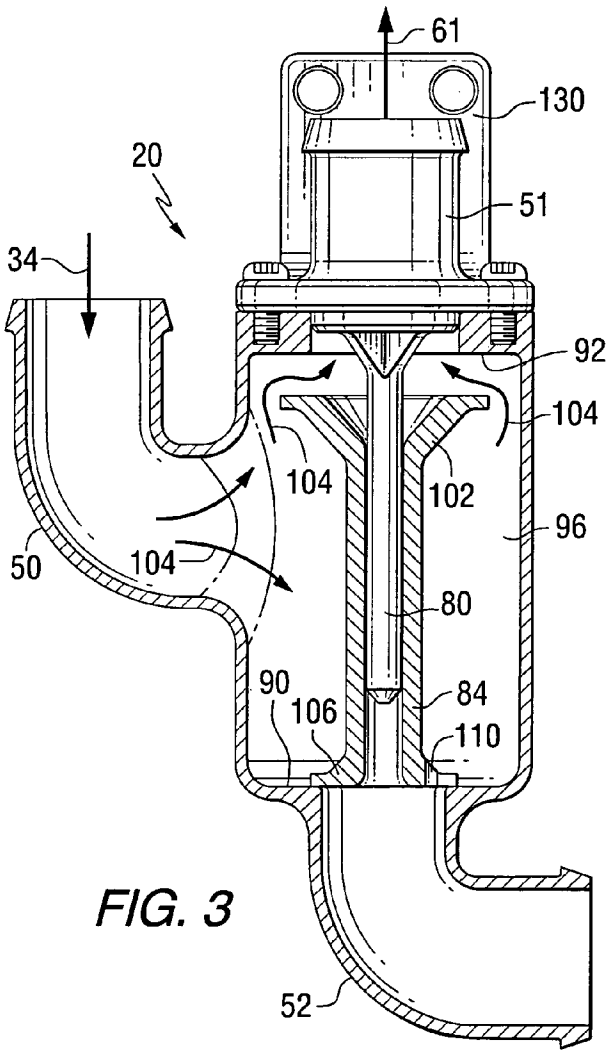

FIGS. 3 and 4 show the valve 20 in two alternative positions of the movable member 84. In FIG. 3, the movable member 84 is in its downward position with its lower portion 106 in contact with the lower surface 90. This is the configuration in which the valve 20 responds to a relatively low flow of water into the inlet 50 from the pump. This flow may fill the chamber 96 and induce a moderate flow of cooling water upwardly through the first outlet toward the exhaust elbow 70 and elastomeric component 74 as described above in conjunction with FIG. 1. However, at low flow rates, the flow from the pump 10 through the inlet 50 is not sufficient to raise the movable member 84 and block the first outlet 50. As water flows upwardly through the first outlet 51, some water also flows through the opening 110 in the lower portion 106 of the movable member 84 toward the exhaust manifold. When the pump speed increases and the pressure within the inlet 50 rises above a predetermined magnitude, the pressure within the chamber 96 will cause the movable member 80 to rise. This movement of the movable member 84 is facilitated by the greater effective area of the upper portion 102 compared to the lower portion 106. When the movable member 84 rises, it blocks the first outlet 51 and causes all of the water flowing into the inlet 50 to flow out of the second outlet 52 to the exhaust manifold 44. That water continues to flow through the cooling jackets of both the exhaust manifold and exhaust elbow and also it causes this cooling water to flow in thermal communication with the elastomeric member 74.

Figure 5:
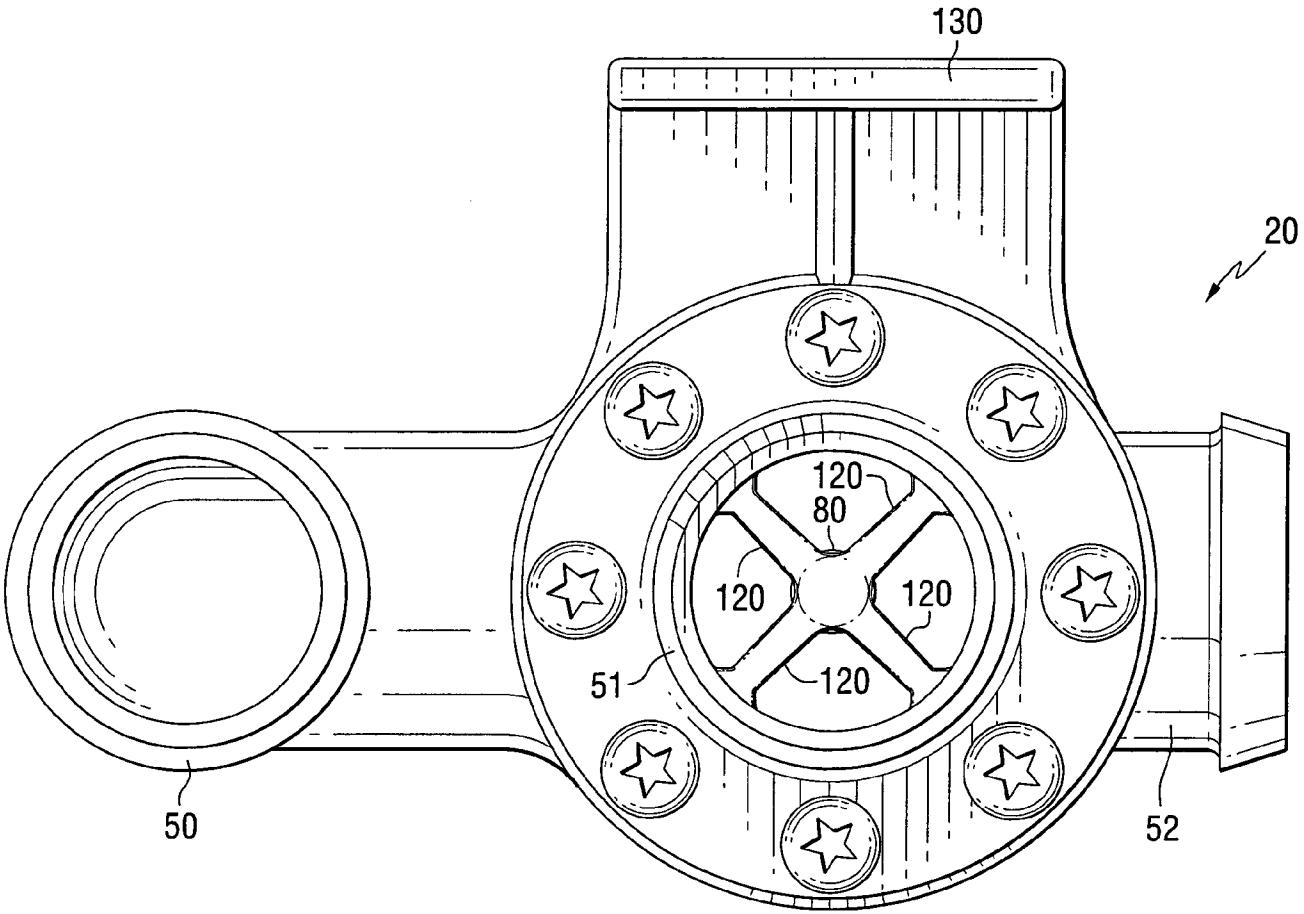
FIG. 5 is a top view of the valve of the present invention.

FIG. 5 is a top view of the valve shown in FIGS. 2-4. Four support ribs connect the rod portion of the guide member 80 to the upper part of that structure which is formed as an integral portion of the first outlet 51 in a preferred embodiment of the present invention.

Figure 6:
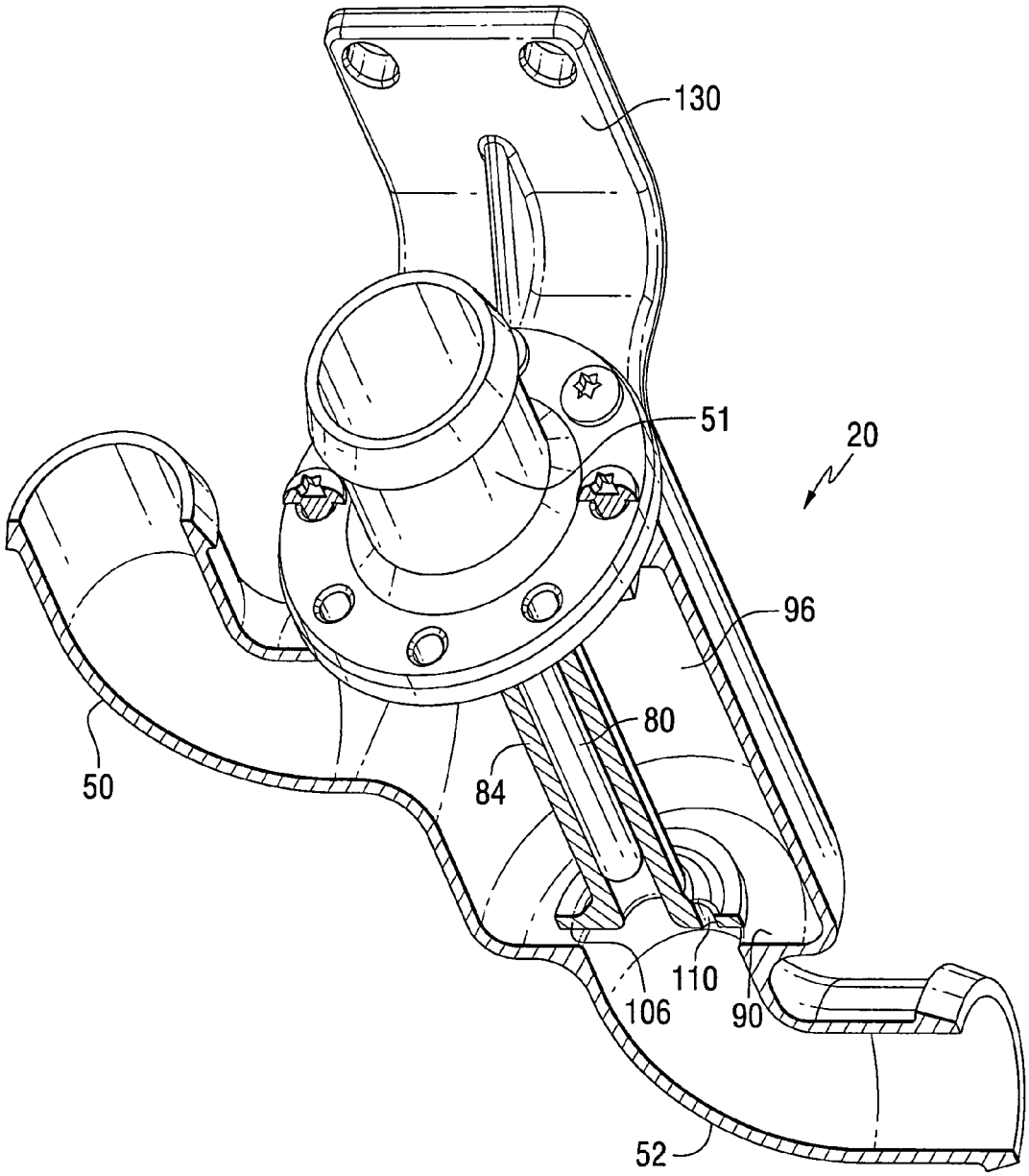
FIG. 6 is a sectioned isometric view of a valve of the present invention.

FIG. 6 is a sectioned isometric view of the valve 20 described above. With reference to FIGS. 2-6, the valve structure comprises only three components in a preferred embodiment of the present invention. One component forms the inlet 50, the second outlet 52, and the chamber 96 of the valve 20. A second component forms the first outlet 51, the guide rod 80, and the support bracket 130. The third element of the valve 20 is the movable member 84 that is slidably supported by the guide rod. Although alternative configurations of the valve 20 can comprise more numerous elements, the embodiment shown in the figures requires only three main components (in addition to the threaded screws shown in the figures) . This simple device controls the flow through the first and second cooling paths as a function of the operating speed of the pump 10. As a result, it distributes cooling water to the exhaust manifold 44 and exhaust elbow 70 in desirable proportion as the engine speed and pump 10 change. In this way, it prevents the exhaust manifold 44 from being overcooled during slow operation of the engine and pump 10 while also providing a flow of water to the exhaust elbow 70 even at low pump speeds. When the pump speed increases, the exhaust manifold 44 is provided with ever increasing magnitudes of cooling water flow which also continued to flow through the exhaust elbow 70 and elastomeric member 74.

With reference to FIGS. 1-6, it can be seen that a cooling system for a marine propulsion system in accordance with a preferred embodiment of the present invention comprises a water pump 10, a first coolant path 61, a second coolant path 62, and a valve 20 having an inlet 50 connected in fluid communication with the water pump 10, a first outlet 51 connected in fluid communication with the first coolant path 61, and a second outlet 52 connected in fluid communication with the second coolant path 62. The valve is configured to increase coolant flow through the second outlet 52 and decrease coolant flow through the first outlet 51 in response to an increase in water pressure within the inlet 50 from a first magnitude to a second magnitude. The valve 20 comprises a guide member 80 and a movable member 84 slidably supported on the guide member 80. The guide member 80 is stationary relative to the first and second outlets, 51 and 52. The movable member 84 is movable toward the second outlet 52 solely in response to the weight of the movable member 84 in a preferred embodiment of the present invention. The movable member 84 is movable toward the first outlet 51 in response to the increase in water pressure within the inlet 50 above a threshold magnitude. The first coolant path 61 is disposed in fluid communication with a non-metallic component 74 (such as an elastomeric member) of an exhaust system of the marine propulsion system. The second coolant path 62 is disposed in fluid communication with an exhaust manifold 44 of the marine propulsion system. The movable member 84 comprises a first pressure responsive surface and a second pressure responsive surface, of the upper and lower portions, 102 and 106, with the first pressure responsive surface having a greater area than the second pressure responsive surface. The guide member 80 comprises a rod and the movable member 84 is slidably supported on the rod for reciprocal movement between the first and second outlets, 51 and 52, in a preferred embodiment of the present invention. The rod 80 is rigidly attached to a housing of the valve 20 and is stationary relative to the first and second outlets, 51 and 52.

Although the present invention has been described with particular detail and illustrated to show a specific embodiment, it should be understood that alternative embodiments are also within its scope.

I claim:

1. A cooling system for a marine propulsion system, comprising:

a water pump;

a first coolant path;

a second coolant path; and a valve having an inlet connected in fluid communication with said water pump, a first outlet connected in fluid communication with said first coolant path, and a second outlet connected in fluid communication with said second coolant path, said valve being configured to increase coolant flow through said second outlet and decrease coolant flow through said first outlet in response to an increase in water pressure within said inlet from a first magnitude to a second magnitude, said valve comprising a guide member and a movable member slidably supported on said guide member, said movable member comprising a first pressure responsive surface and a second pressure responsive surface, said first pressure responsive surface having a greater area than said second pressure responsive surface.

2. The cooling system of claim 1, wherein:

said guide member is stationary relative to said first and second outlets.

3. The cooling system of claim 1, wherein:

said movable member is movable toward said second outlet solely in response to the weight of said movable member.

4. The cooling system of claim 3, wherein:

said movable member is movable toward said first outlet in response to said increase in water pressure within said inlet above a threshold magnitude.

5. The cooling system of claim 1, wherein:

said guide member comprises a rod and said movable member is slidably supported on said rod for reciprocal movement between said first and second outlets.

6. The cooling system of claim 5, wherein:

said rod is rigidly attached to a housing of said valve and is stationary relative to said first and second outlets.

7. The cooling system of claim 1, wherein:

said first coolant path is disposed in fluid communication with a nonmetallic component of an exhaust system of said marine propulsion system.

8. The cooling system of claim 1, wherein:

said second coolant path is disposed in fluid communication with an exhaust manifold of said marine propulsion system.

9. A cooling system for a marine propulsion system, comprising:

a water pump;

a first coolant path;

a second coolant path; and a valve having an inlet connected in fluid communication with said water pump, a first outlet connected in fluid communication with said first coolant path, and a second outlet connected in fluid communication with said second coolant path, said valve being configured to increase coolant flow through said second outlet and decrease coolant flow through said first outlet in response to an increase in water pressure within said inlet from a first magnitude to a second magnitude, said valve comprising a guide member and a movable member slidably supported on said guide member, said guide member being stationary relative to said first and second outlets, said movable member being movable toward said second outlet solely in response to the weight of said movable member, said guide member comprising a rod and said movable member is slidably supported on said rod for reciprocal movement between said first and second outlets.

10. The cooling system of claim 9, wherein:

said movable member is movable toward said first outlet in response to said increase in water pressure within said inlet above a threshold magnitude, said first coolant path being disposed in fluid communication with a nonmetallic component of an exhaust system of said marine propulsion system, said second coolant path being disposed in fluid communication with an exhaust manifold of said marine propulsion system.

11. The cooling system of claim 10, wherein:

said movable member comprises a first pressure responsive surface and a second pressure responsive surface, said first pressure responsive surface having a greater area than said second pressure responsive surface.

12. The cooling system of claim 9, wherein:

said rod is rigidly attached to a housing of said valve and is stationary relative to said first and second outlets.

13. A cooling system for a marine propulsion system, comprising:

a water pump;

a first coolant path;

a second coolant path; and a valve having an inlet connected in fluid communication with said water pump, a first outlet connected in fluid communication with said first coolant path, and a second outlet connected in fluid communication with said second coolant path, said valve being configured to increase coolant flow through said second outlet and decrease coolant flow through said first outlet in response to an increase in water pressure within said inlet from a first magnitude to a second magnitude, said valve comprising a guide member and a movable member slidably supported on said guide member, said guide member comprising a rod and said movable member is slidably supported on said rod for reciprocal movement between said first and second outlets, said rod being rigidly attached to a housing of said valve and is stationary relative to said first and second outlets, said movable member comprising a first pressure responsive surface and a second pressure responsive surface, said first pressure responsive surface having a greater area than said second pressure responsive surface.

14. The cooling system of claim 13, wherein:

said movable member is movable toward said second outlet solely in response to the weight of said movable member.

15. The cooling system of claim 14, wherein:

said movable member is movable toward said first outlet in response to said increase in water pressure within said inlet above a threshold magnitude.

16. The cooling system of claim 15, wherein:

said first coolant path is disposed in fluid communication with a nonmetallic component of an exhaust system of said marine propulsion system.

17. The cooling system of claim 13, wherein:

said second coolant path is disposed in fluid communication with an exhaust manifold of said marine propulsion system.

* * * * *